US006298214B1

(12) United States Patent
Koga

(10) Patent No.: US 6,298,214 B1
(45) Date of Patent: Oct. 2, 2001

(54) FIXING APPARATUS HAVING SHEET GUIDE

(75) Inventor: Hiroto Koga, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/544,131

(22) Filed: Apr. 6, 2000

(30) Foreign Application Priority Data

Apr. 8, 1999 (JP) ..... 11-101413
Mar. 31, 2000 (JP) ..... 12-099283

(51) Int. Cl.[7] ..... G03G 15/20
(52) U.S. Cl. ..... 399/322; 399/405
(58) Field of Search ..... 399/322, 405, 399/406, 400; 219/216

(56) References Cited

U.S. PATENT DOCUMENTS 5,149,941 9/1992 Hirabayashi et al. ..... 219/216
5,237,381 * 8/1993 Hamada ..... 399/406
5,285,245 * 2/1994 Goto et al. ..... 399/322
5,289,244 * 2/1994 Takano ..... 399/322
5,528,345 * 6/1996 Hasegawa ..... 399/122
5,862,435 * 1/1999 Suzumi et al. ..... 399/68
5,933,694 * 8/1999 Yamashita et al. ..... 399/322
6,064,853 * 5/2000 Embry et al. ..... 399/406

FOREIGN PATENT DOCUMENTS 57-104965 * 6/1982 (JP) .
63-313182 12/1988 (JP) .
04-204984 7/1992 (JP) .

* cited by examiner

*Primary Examiner*—Robert Beatty
(74) *Attorney, Agent, or Firm*—Fitzpatrick, Cella, Harper & Scinto

(57) ABSTRACT

The present invention relates to a fixing apparatus that has fixing device for forming a fixing nip, recording material bearing an unfixed image being pinched and conveyed in the fixing nip and the unfixed image being fixed on the recording material. The recording material discharged from the fixing nip is curled downwardly, and a guide member guides the recording material discharged from the fixing nip. The guide member is slanted upwardly from an upstream side to a downstream side in the recording material conveying direction, and the guide member has a first guide portion and a second guide portion provided downstream in the recording material conveying direction of the first guide portion wherein a slant angle of the first guide portion is greater than a slant angle of the second guide portion.

31 Claims, 11 Drawing Sheets

FIXING APPARATUS HAVING SHEET GUIDE

BACKGROUND OF THE INVENTION

1. Field of the Invention

The present invention relates to a fixing apparatus applied to an image forming apparatus such as a copying machine, a printer and the like.

2. Related Background Art

As a conventional image heating and fixing apparatus for heating and melting an image borne on a recording material and for fixing it on the recording material, a heat roller fixing method has been widely used which has a heating roller kept at a predetermined temperature and a pressure roller with an elastic layer for pressing the heating roller, to thereby heating the recording material on which an unfixed toner image is formed while pinching and conveying the recording material by both the rollers.

However, for example, this heat roller fixing method suffers from the following disadvantages. Firstly, the method needs a rather long period of time for prohibiting the image forming operation until a predetermined temperature is reached, so-called wait time. Secondly, since a heat capacity is needed, a relatively large amount of electric power is needed. Thirdly, since the roller temperature of the rollers is high, a heat resistant special bearing is needed. Fourthly, it is necessary to take a structure such that a user's hand comes into direct contact with the roller, and therefore, a protective member therefor is needed to avoid danger. Fifthly, the recording member is wound around the roller due to the roller fixing temperature and the curvature of radius of the roller, which leads to a cause of generation of jam.

Therefore, in a film heating type fixing method proposed by the present applicant, it is possible to use a low heat capacity linear heating member in comparison with the above-described heat roller fixing method or any other well known thermal fixing systems such as a belt drive method, a flash fixing method, or an oven fixing method. Accordingly, the electric power saving (i.e., quick start property) is possible. Also, since the fixing point and the separation point can be set separately, the offset may be prevented. In addition, the proposed method may solve the other disadvantages inherent in the other systems employing other methods, and is effective.

For instance, the method, apparatus or the like disclosed in Japanese Patent Application Laid-Open No. 63-313182 belongs to the above-described proposal made by the present applicant. This method or system includes a thin heat resistant film (sheet), a moving drive means for this film, a heating member disposed and fixedly supported to one surface side while pinching the film, a pressure member for bringing the surface bearing a visualized image of a recording material to be image processed and fixed via the film into contact with the heating member, or the like.

The above-described film travels and moves at the same velocity in the forward direction together with the recording material, to be image processed and fixed, which is conveyed and introduced in between the film and the pressure member at least upon executing the image fixing. The recording material passes through a fixing nip portion formed (defined) by the pressure contact between the heating member and the pressure member while pinching the traveling and moving film so that the visualized image bearing surface of the recording material is heated by the heating member via the film and heat energy is applied to the visualized image to be softened and molten.

Subsequently, the film and the recording material are separated away. Alternatively, the film and the recording material are separated away from each other after a toner is cooled and solidified.

In such a film heating type fixing system, an electric supply heat generating layer having a direction that perpendicular to the moving and passing direction of the recording material in a longitudinal direction is provided. When the voltage is applied between electric supply electrodes of both terminal portions in the longitudinal direction of this electric supply heat generating layer, each portion in an effective entire length region of the heat generating layer generates heat with a certain heat generation amount per unit length. The effective entire length region of the heat generating layer has a length corresponding to a width (maximum width, maximum size width) of the maximum size recording material that may be fed and used in the image forming apparatus into which the fixing apparatus is assembled.

When the fixing operation is executed, the effective entire length region of the heat generating layer is energized to heat with a predetermined heat generation amount per unit length regardless of the extent of the size width of the used recording material.

However, the above-described conventional film heating type fixing system suffers from the following possible problems.

FIGS. 10A, 10B and 10C are views showing the fixing apparatus that is made according to the background art of the present invention.

As shown in FIG. 10A, a fixing nip portion A is formed by the pressure contact between a substantially flat heating member 61 and a roll-shaped pressure member 7 while pinching a cylindrical fixing film 65. As shown in FIG. 10B, a mechanical hysteresis is likely to be left on the side of the pressure member 7 in the recording material S passing through the fixing nip portion A. Namely, the recording material is likely to be discharged under a downward curl condition (a convex condition upwardly). In particular, this curl is likely to be appeared at a tip end of the recording material.

The image is fixed by using the heating member 61 having a low heat capacity to instantaneously apply the heat energy to the recording material S via the film 65. Therefore, as shown in FIG. 10C, in particular after the start of the apparatus, the temperature difference from the pressure member 7 is remarkable, the downward curl of the recording material S is remarkable, and in some cases, even the creases are generated in the recording material S.

Also, the generation of the curl or crease in the recording material S leads not only to a degradation in quality of the discharged recording material but also to lowered performance in stacking the discharged recording material and a feeding trouble in sheet feeding of double-sided sheet or in sheet feeding by ADF. This leads to less reliability of the apparatus itself.

Therefore, the present applicant proposes to take countermeasures against the curl of the recording material, in which, as shown in FIG. 11, a guide 80 on the side of the outlet of the nip portion is raised upwardly from below an extension line 81 of the nip portion.

However, the slant of this guide is relatively gentle and would not be sufficient for correcting the relatively large curl generated in the recording material, in particular, the large curl generated at the tip end of the recording material.

SUMMARY OF THE INVENTION

An object of the present invention is to provide a fixing apparatus for correcting a relatively large curl of recording material.

Another object of the present invention is to provide a fixing apparatus that stabilizes the transfer of the recording material while correcting the curl of the recording material.

Still another object of the present invention is to provide a fixing apparatus comprising a fixing means for forming a fixing nip and a guide member for guiding the recording material discharged from the fixing nip, wherein a recording material bearing an unfixed image is pinched and conveyed in the fixing nip and the unfixed image is fixed on the recording material, the recording material discharged from the fixing nip is curled downwardly, the guide member is slanted (inclined) upwardly from the upstream side to the downstream side of the recording material conveying direction, the guide member has a first guide portion and a second guide portion provided downstream in the recording material conveying direction of the first guide portion, and a slant of the first guide portion is greater than a slant of the second guide portion.

Still another object of the present invention is to provide a fixing apparatus comprising a fixing means for forming a fixing nip and a guide member for guiding the recording material discharged from the fixing nip, wherein a recording material bearing an unfixed image is pinched and conveyed in the fixing nip and the unfixed image being fixed on the recording material, and the recording material discharged from the fixing nip is curled downwardly, the guide member is slanted upwardly from the upstream side to the downstream side of the recording material conveying direction, and the slant angle of the guide member in the recording material conveying direction in the fixing nip is not less than 40 degrees but not greater than 65 degrees.

The further objects will now become apparent by the following descriptions.

DESCRIPTION OF THE PREFERRED EMBODIMENTS

An embodiment of the present invention will now be described in detail with reference to the accompanying drawings.

FIGS. 1 to 4 show a first embodiment of the present invention.

Figure 4:
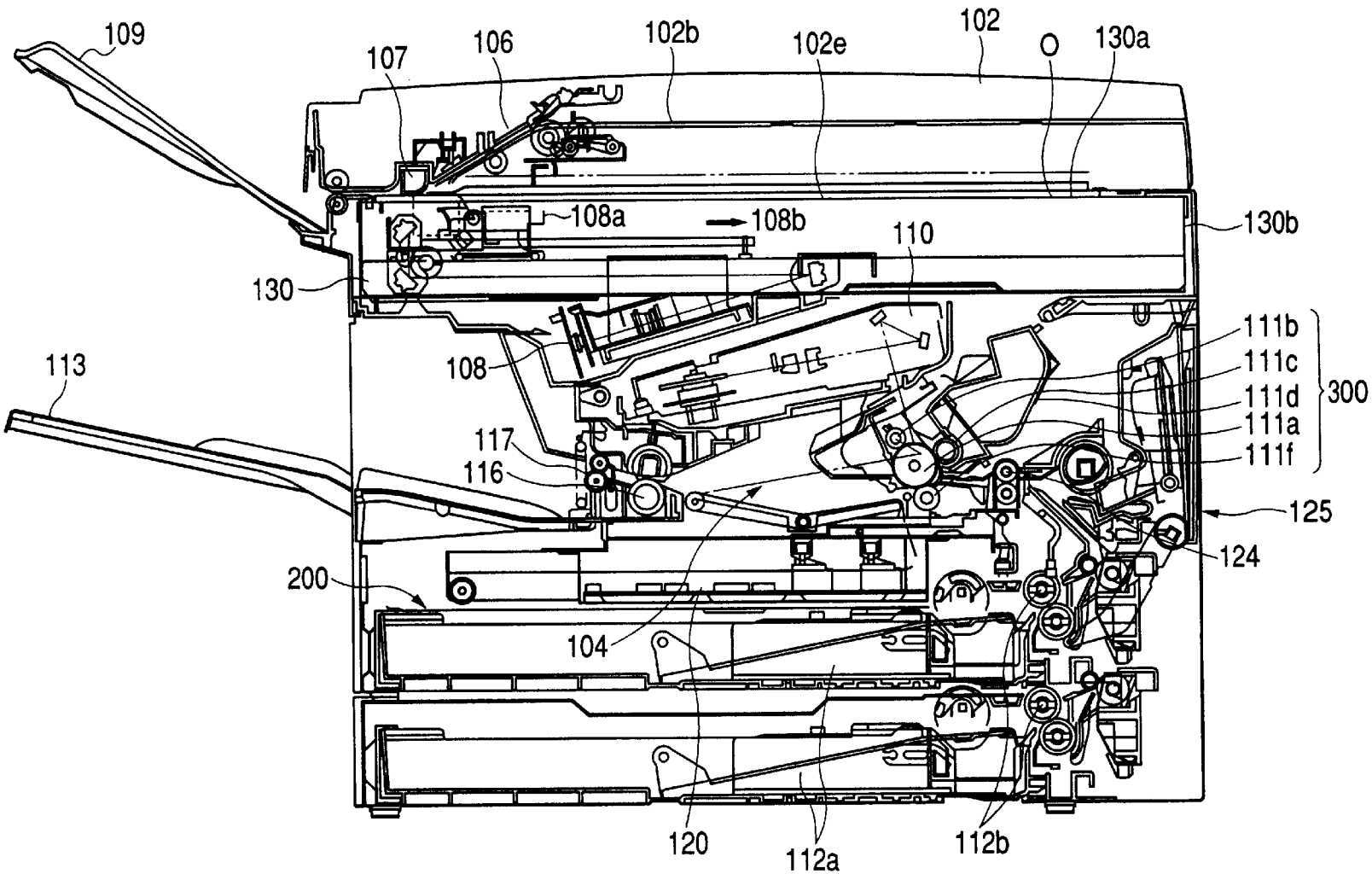
FIG. 4 is an illustration of an image forming apparatus to which the present invention may be applied.

FIG. 4 is a cross-sectional view showing a primary part of a digital copying machine in accordance with the first embodiment of the present invention. In FIG. 4, reference numeral 130 denotes a flat bed scanner for reading (out) an original O laid on an original stand glass 130*a* by moving a scanner means 108*a* in a direction indicated by an arrow 108*b*. Reference numeral 102 denotes a pressure plate that may be opened and closed up and down as desired by a user, for depressing the original O laid on the original stand glass 130*a*. Reference numeral 108 denotes a CCD image sensor for reading out an image. Reference character 102*e* denotes an upper plate of the scanner and numeral 130*b* denotes a side plate of the scanner.

The original may be also read by the following manner. An original stand 102*b* that is constructed so that a plurality of originals O may be stacked on the original stand is provided on a top surface of the pressure plate 102. Reference numeral 106 denotes an original convey portion for conveying the originals O while separating the originals one by one separately for reading the original while conveying the original to a sheet readout portion 107 where the originals are read out. Here the original convey portion 106 is provided on a part of the pressure plate 102 and is moved up and down together with the opening/closing operation of the pressure plate 102. Reference numeral 109 denotes an original discharge tray on which the discharged originals are stacked.

Reference numeral 104 denotes a recording device portion composed of a laser printer, reference numeral 200 denotes a cassette sheet feed portion, reference numeral 125 denotes a manual sheet feed portion, reference numeral 300 denotes an image forming portion, reference numeral 116 denotes a fixing apparatus, reference numeral 117 denotes a pair of sheet discharge rollers, and reference numeral 113 denotes a recording material discharge tray on which the discharged recording materials are stacked.

The recording device portion 104 is disposed in the lower portion of the apparatus. A stack of regular size recording materials S received within a cassette 112*a* are separated one by one by feed rollers 112*b*. The skew feed of the recording materials S is corrected by a pair of registration rollers 124. The recording material S is fed to the image forming portion 300 in synchronism with a print signal from a controller 120.

Then, a surface of a photosensitive drum 111*a* that is an electrostatic latent image bearing member is uniformly charged by a charging member 111*b*. This surface is exposed on the basis of the image information by a laser scanner 110.

Thus, the electrostatic latent image is formed on the photosensitive drum 111*a*. The toner that is developer of the above-described image forming portion is transferred to the electrostatic latent image on the photosensitive drum 111*a* by a developing sleeve 111*c* that is a developer bearing member so that the toner image is formed on the photosensitive drum 111*a*.

The above-described toner image borne on the photosensitive drum 111*a* is transferred to the recording material S by a transfer roller 111*f*. Furthermore, the above-described recording material S bearing the toner image is conveyed to the fixing device 116. Reference character 111*d* designates a frame member of a cartridge for containing (receiving) the photosensitive drum 111*a*, the charging member 111*b*, the developing sleeve 111*c* and the like.

Figure 1:
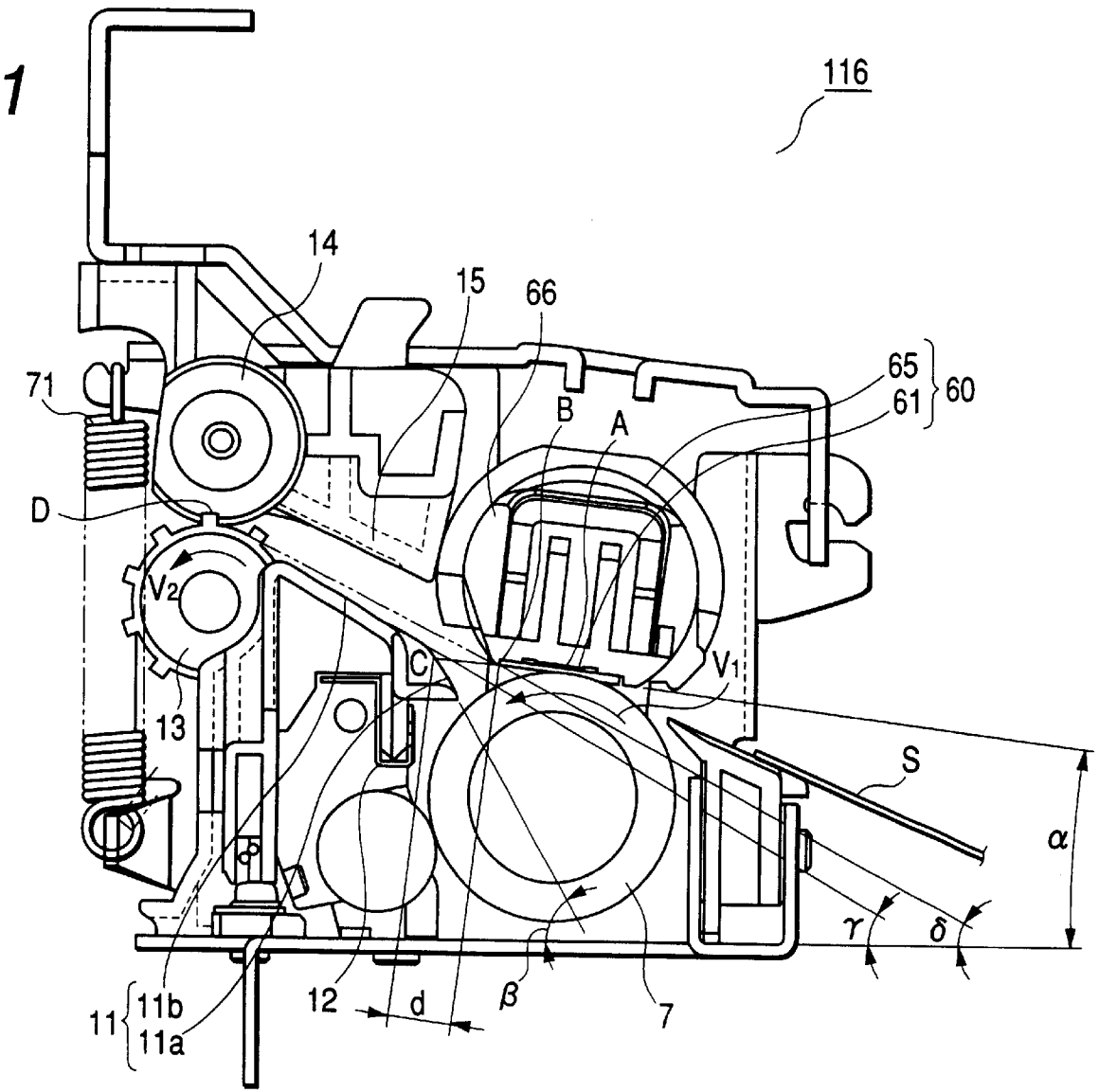
FIG. 1 is an illustration of a fixing apparatus in accordance with an embodiment of the present invention.

The fixing device 116 is provided with a heater unit 60 and the pressure roller 7 (see FIG. 1). Then the above-described toner image is fixed on the recording material S by this fixing device 116 and discharged onto the discharge tray 113.

Here the fixing apparatus 116 in accordance with this embodiment is the film heating and fixing apparatus as shown in FIG. 1. This will be described in detail.

In FIG. 1, reference character 60 denotes the heater unit. Reference numeral 65 denotes the cylindrical heat resistant film including a polyimide film having a thickness of 40 to 60 $\mu$m which is used as a base layer, and PFA having a thickness of 5 to 20 $\mu$m and a peel layer with PTFE dispersed into the PFA which are formed on the outer circumferential surface (the surface that is brought into contact with the recording material and with the toner image of the film).

Reference numeral 61 denotes a heater used as a heating member. This heater 61 is basically composed of a ceramic substrate, with insulation, heat resistance and low heat capacity, whose longitudinal direction is perpendicular to the conveying direction of the recording materials S, a resistor heat generating member printed along the longitudinal direction on the surface of the substrate and a thermistor as a temperature detecting element provided on one side of the above-described ceramic substrate which is opposite to the side where the resistor heat generating member is formed.

On the other hand, the pressure roller 7 as the pressure member is pressurized at a pressure P1 by pressure springs 71 provided at both end portions in the longitudinal direction of the heater 61. The pressure roller 7 is driven and rotated (counterclockwise) by a drive system (not shown) in the conveying direction of the recording material S. Thus, the cylindrical heat resistant film 65 is brought into sliding and intimate contact with the surface of the heating member of the heater 61 and rotated around a film guide 66. Also, at this time, in order to reduce the sliding friction of the film inner surface of the heater, a heat resistant grease is interposed between the heater and the film.

With such an arrangement, the recording material S is guided between the film 65 and the pressure roller 7 and passes through the fixing nip portion to thereby fix the toner image on the recording material. After the fixing operation, the recording material S is discharged while being pinched and conveyed by the discharge roller 13 and by a discharge roller 14 that is biased to the discharge roller 13 by a biasing means (not shown).

The fixing apparatus 116 in accordance with this embodiment will now be described in detail with reference to FIG. 1. The primary part of the fixing device according to this embodiment will first be described. Character A represents a fixing nip, character B represents a fixing heater outlet that is an end portion of the fixing means on an extension line of the fixing nip A, character C represents an intersection between an extension line of the fixing nip tangent line and a lower guide inlet slant (inclined) surface and character D represents a discharge roller nip. Here a sheet discharge lower guide 11 used as a lower guide of the sheet discharge guide is formed so that an inlet slant surface 11*a* that is a first guide portion on the upstream side of the guide surface in the travel direction of the recording material, an outlet slant surface 11*b* that is a second guide portion on the downstream side, and a portion between surfaces 11*a* and 11*b* are smoothly connected to one another forming an arcuate line. The following relationships are given:

$$\alpha<\beta \quad (1)$$

$$\gamma<\beta \quad (2)$$

$$\alpha<\delta \quad (3)$$

where $\alpha$ is the fixing nip angle relative to the horizontal line, $\beta$ is the sheet discharge lower guide inlet angle, $\gamma$ is the sheet discharge lower guide outlet angle and $\delta$ is the fixing-sheet discharge angle (the angle of a line BD).

Also, the following relationship is given:

$$V1<V2 \quad (4)$$

where V1 is the velocity of the pressure roller (fixing film) and V2 is the velocity of the sheet discharge roller.

The following relationship is given:

$$P1>P2 \quad (5)$$

where P1 is the fixing contact pressure and P2 is the contact pressure of the sheet discharge roller.

Figure 3A:
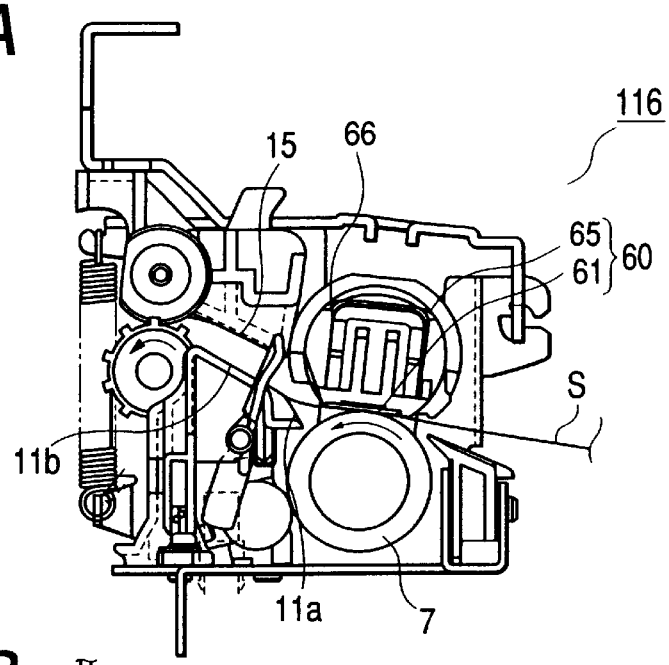
FIGS. 3A, 3B and 3C are illustrations of curl correction of a recording material.
Figure 3B:
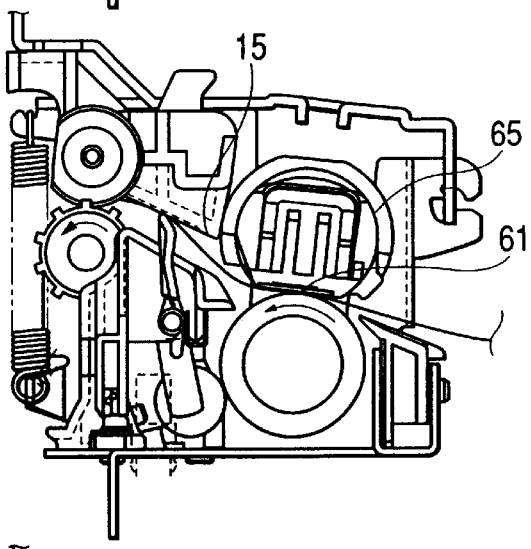

The operation of the fixing device will now be described. First of all, heat and pressure are given in the fixing nip A to the recording material S on which unfixed image is recorded on the engine side as described above to be fixed to obtain a permanent image. Thereafter, the tip end portion of the recording material S is advanced with the downward curl tendency. However, the relationship, $\alpha<\beta$, is established, the lower guide inlet slant surface 11*a* is provided so as to intersect with the extension line of the fixing nip tangential line at C, and furthermore, a distance d between the fixing heater outlet B and the above-described C is short. For this reason, the tip end portion of the recording material S is brought into contact while it is hot in the vicinity of C so that, as shown in FIG. 3A, it changes its advance direction upwardly, that is, the downward curl on the tip end side of the recording material may be corrected. Thereafter, the tip end portion of the recording material S is advanced along the sheet discharge upper guide 15 as if it would jump up as shown in FIG. 3B.

Figure 3C:
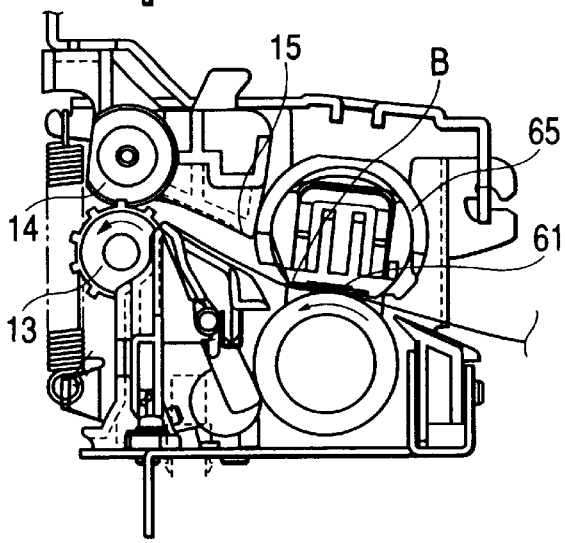

When the recording material S is further advanced into the space between the pair of discharge rollers 13 and 14 and is laid on both the fixing nip A and the sheet discharge roller nip D as shown in FIG. 3C, the velocity of the recording material S is dependent on the velocity V1 of the pressure roller in accordance with the relationship (4) and (5). Namely, the recording material S is slid between the sheet discharge rollers. At this time, the recording material S is tensioned between the fixing heater outlet B and the sheet discharge nip D and is jerked and pulled out at the heater outlet B while being drawn in stroke. For this reason, the recording material S is subjected to an upward reforming (curling) over the entire paper length, that is, the downward curl correction is effected.

Figure 9A:
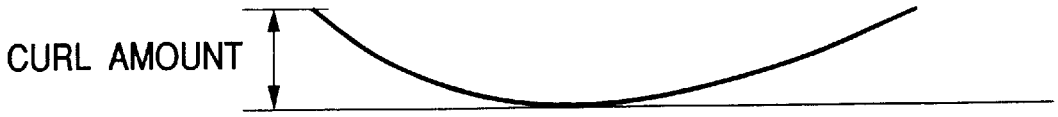
FIGS. 9A and 9B are views illustrating the relationship between a curl amount and a slant angle of the guide.
Figure 9B:
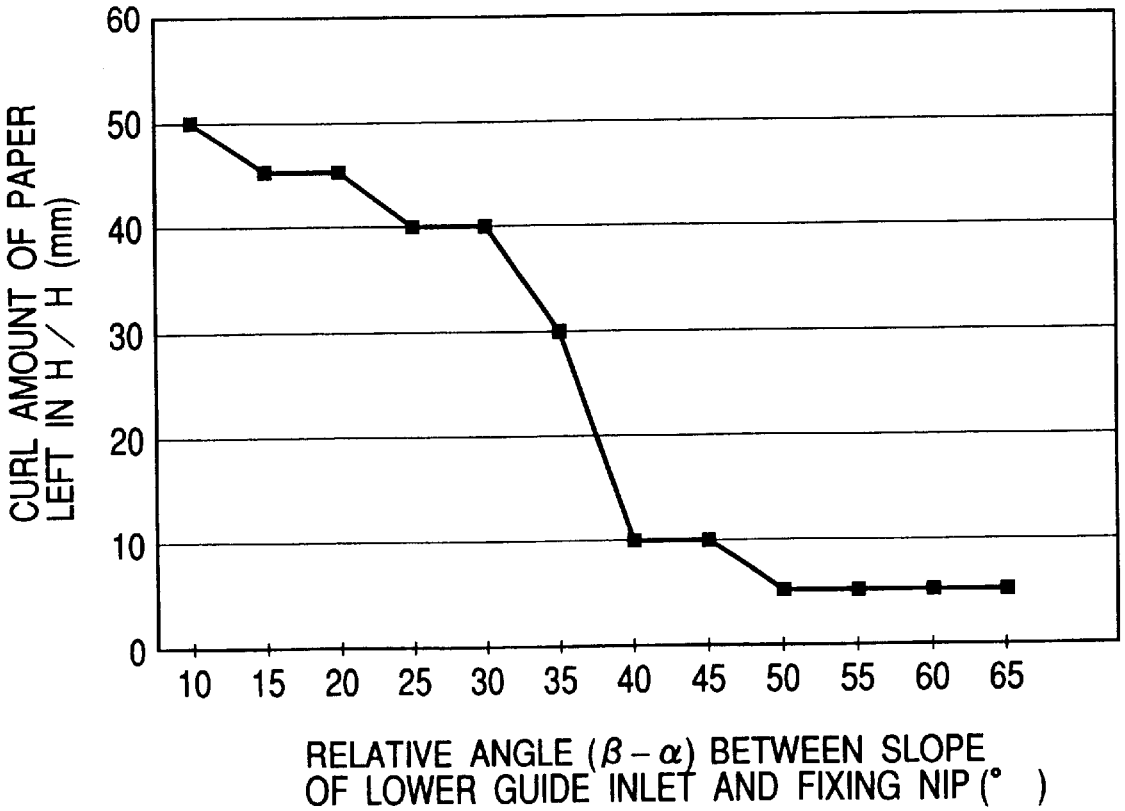
Figure 10A:
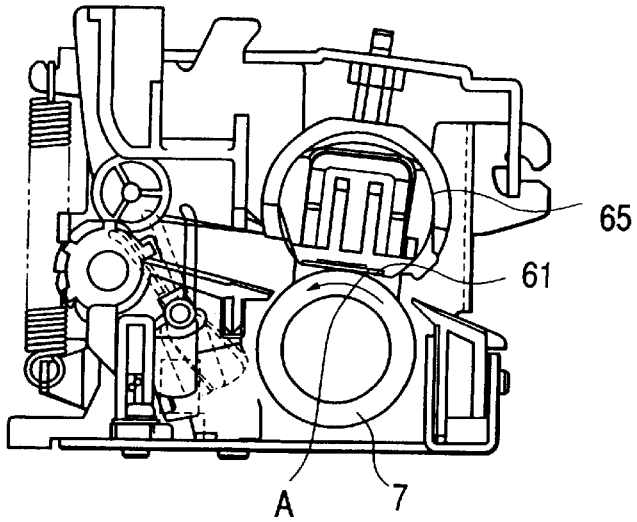
FIGS. 10A, 10B and 10C are views showing a fixing apparatus according to the background technique of the present invention.
Figure 10B:
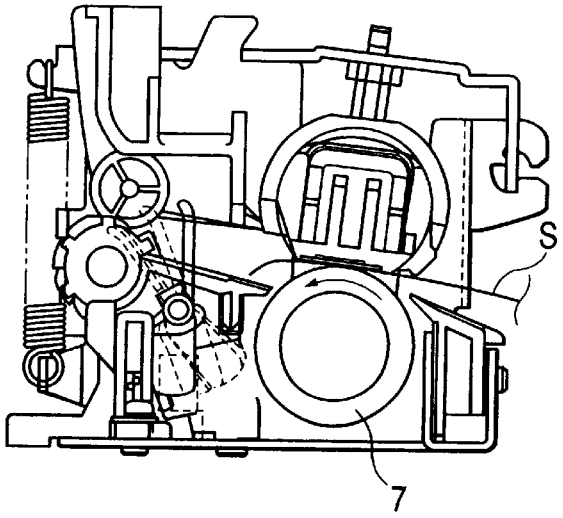
Figure 10C:
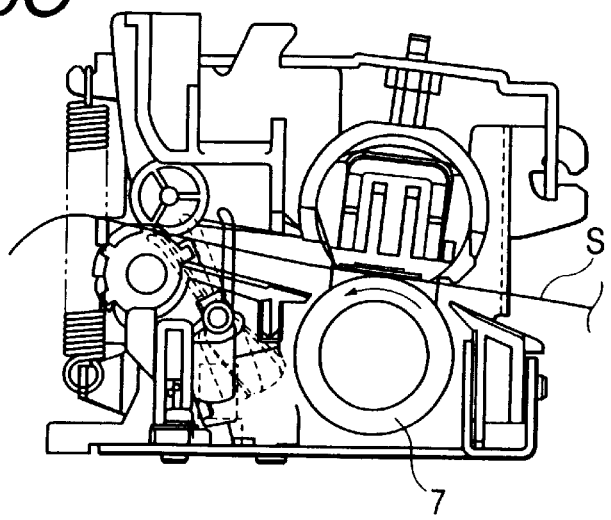
Figure 11:
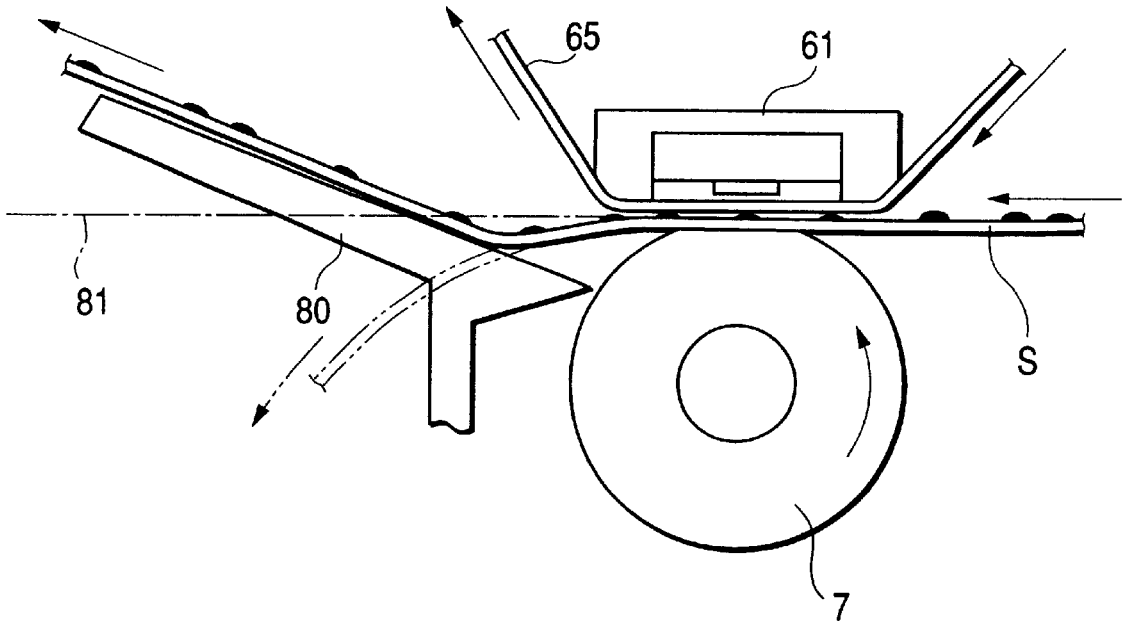
FIG. 11 is a view showing a conventional fixing apparatus.

The relationship in curl amount improvement by the lower guide inlet slant angle will now be described. The comparison was made with the maximum data immediately after the discharge of the sheet exposed in the H/H environment (circumstances) (high temperature and high humidity circumstances) that is the severest condition. FIGS. 9A and 9B show the relationship between the relative angle ($\alpha-\beta$) of the lower guide inlet slant (angle) and the fixing nip and the curl amount. As is apparent from these drawings, it is understood that it is preferable that the relative angle ($\beta-\alpha$) between the lower guide inlet slant and the fixing nip be not less than 40 degrees but not greater than 65 degrees. Below 35 degrees, the effect of the curl amount improvement would be insufficient but exceeding 70 degrees, the resistance of the tip end of the recording material was increased to cause the jam.

Thus according to this embodiment, since the slant of the inlet slant surface 11*a* of the sheet discharge lower guide 11 is relatively large, it is possible to correct the relatively large curl of the recording material (in particular the curl at the tip end of the recording material) by this portion. Also, since the slant of the outlet slant surface 11*b* following the inlet slant surface 11*a* is relatively small, it is possible to reduce the convey load of the recording material in comparison with the case where the sheet discharge lower guide as a whole is steep and it is possible to convey the recording material in a stable fashion.

Figure 2:
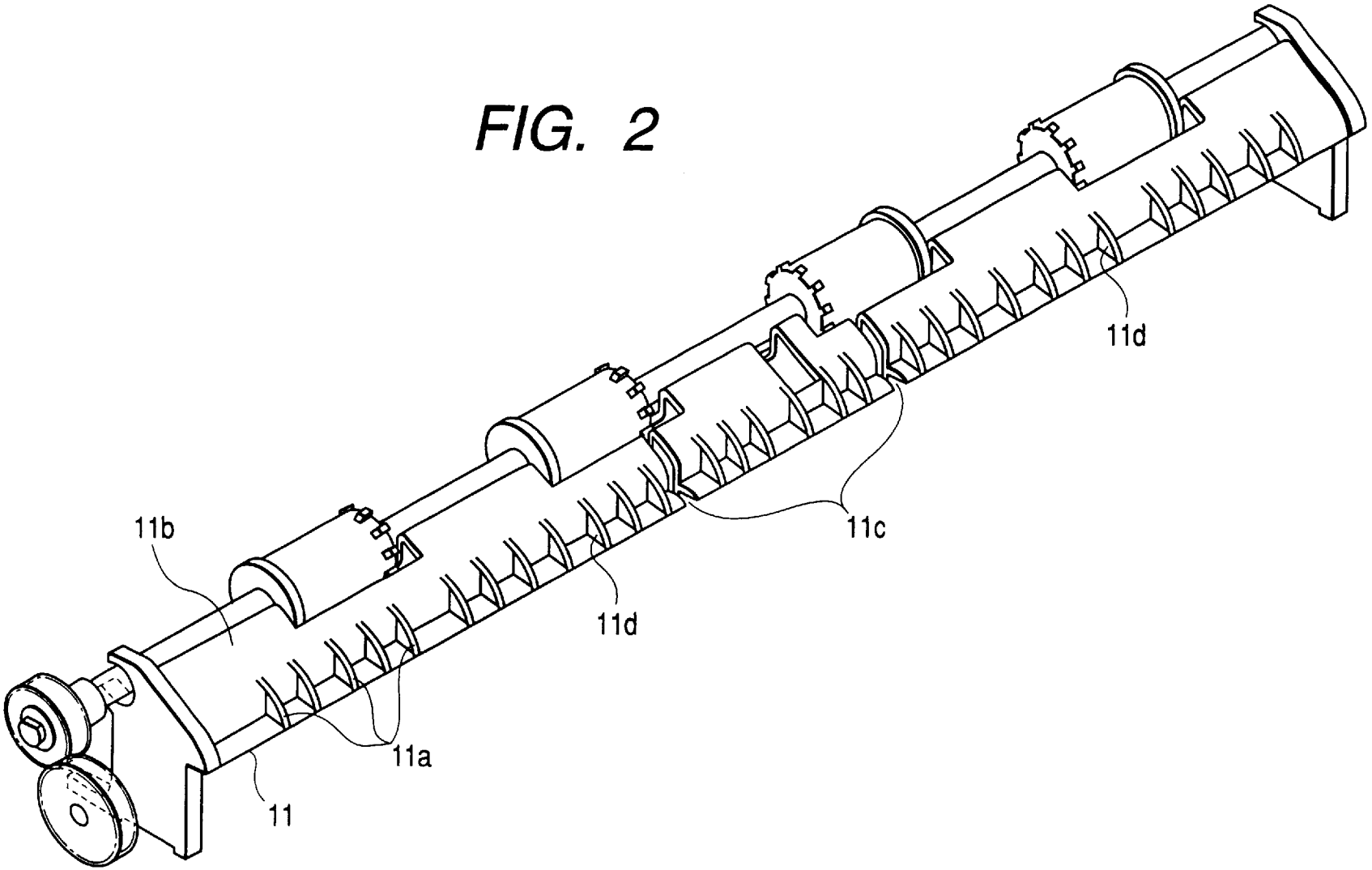
FIG. 2 is a perspective view of a guide member.

Note that, in this embodiment, a plurality of ribs 11*d* are formed in the longitudinal direction on the inlet slant surface 11*a* of the sheet discharge lower guide 11 as shown in FIG. 2. These ribs 11*d* are used as the abutting surfaces with the tip end portion of the recording material S. It is preferable that the sheet discharge lower guide 11 be made of moldable resin. It is most preferable that the guide be made of PBT or PET that may be continuously used in the range of 100 to 150° C. Note that, in the case where the lower guide 11 made of these resins, in view of the deformation of the guide due to the heat expansion, as shown in FIG. 2, cutaways 11*c* are provided to the resin guide so that the deformation due to the heat expansion may be allowed as desired, or as shown in FIG. 1, a reinforcement plate 12 that is hardly thermally expanded like a SUS plate bent in a U-shape is arranged integrally with the resin made sheet discharge lower guide 11 to ensure the rigidity and to obtain a predetermined shape.

Also, the fixing device in accordance with this embodiment exhibits the enhancement in conveying characteristic for a piece of thin paper under the H/H circumferences. As described above, in the fixing device, since the heat and pressure are applied to the recording material S, the moisture contained in the recording material S is evaporated. The evaporated moisture is likely to be left in the space of the fixing device and in particular is likely to be adhere onto the closer inlet slant surface 11*a* of the sheet discharge lower guide 11. If the inlet slant surface is formed by a flat surface extending in the longitudinal direction rather than the ribs, in some cases, the tip end portion of the recording material S that has passed from the fixing nip A would stick to the slanted surface due to the presence of the moisture adhered onto the steep slant surface. There is a fear that the tip end portion would be buckled to cause a so-called accordion jam. In contrast, with the sheet discharge lower guide 11 in accordance with the embodiment, since the inlet slant surface 11*a* is composed of a plurality of ribs, the adhered moisture is small, and since the sliding resistance between the recording material S and the guide ribs is low, there is no fear that the tip end of the recording material is buckled. Thus, it is possible to smoothly perform the curl correction.

As an advantage of the embodiment, it is possible to point out the offset prevention in the both-sided print mode. Namely, as described above, in the fixing apparatus according to this embodiment, as shown in FIGS. 3A, 3B and 3C, the inlet side of the sheet discharge lower guide 11 is formed into a steep slant surface to thereby correct the curl at the tip end portion of the recording material S. Then, the outlet side 11*b* of the sheet discharge lower guide 11 is formed into a surface shape that is gentle and smooth. Accordingly, after the correction of the curl at the tip end portion of the recording material S, the velocity V2 of the sheet discharge roller is greater than the velocity V1 of the fixing velocity and the guide surface of the sheet discharge lower guide 11 is always below the line connecting the fixing heater outlet B and the sheet discharge nip D. Accordingly, it is possible to avoid the unnecessary friction between the lower surface of the recording material S and the guide surface. Also, even if there is some friction, since the gentle slant surface 11*b* of the lower guide is a smooth surface, it is possible to reduce the contact pressure with the recording material S in comparison with the rib contact. Namely, it is possible to avoid the disadvantage that the image surface is drawn in stroke over the guide to be abraded upon the both-sided print mode of the recording material S.

The specific experimental numerical data for the embodiment are given as follows:

$\alpha=7°$, $\beta=60°$, ($\beta-\alpha=40°$ to $65°$), $\gamma=30°$, $\delta=28°$, V1=75 mm/s, V2=79 mm/s, P1=10 kgf(98N), P2=800 kgf(7840N), d=6.5 mm With such experimental conditions, it was possible to obtain the good result.

As described above, in the fixing device in accordance with the embodiment, the correction of the downward curl tendency of the tip end portion of the recording material after the fixing nip is made by the steep slant surface on the upstream side of the sheet discharge lower guide, and furthermore, the correction of the downward curl over the entire recording material is made by imparting the rigidity by the drawing utilizing the convey angle difference and the difference between the sheet discharge velocity and the fixing velocity between the discharge and the fixing nip.

Also, since the outlet side of the sheet discharge guide lower guide is formed into the smooth surface, the velocity V2 of the sheet discharge roller is higher than the velocity V1 of the fixing operation, and the guide surface of the sheet discharge guide 11 is always below the line connecting the fixing heater outlet B and the sheet discharge nip D, the offset due to the friction between the lower surface of the recording medium S and the guide surface may be prevented.

Figure 5:
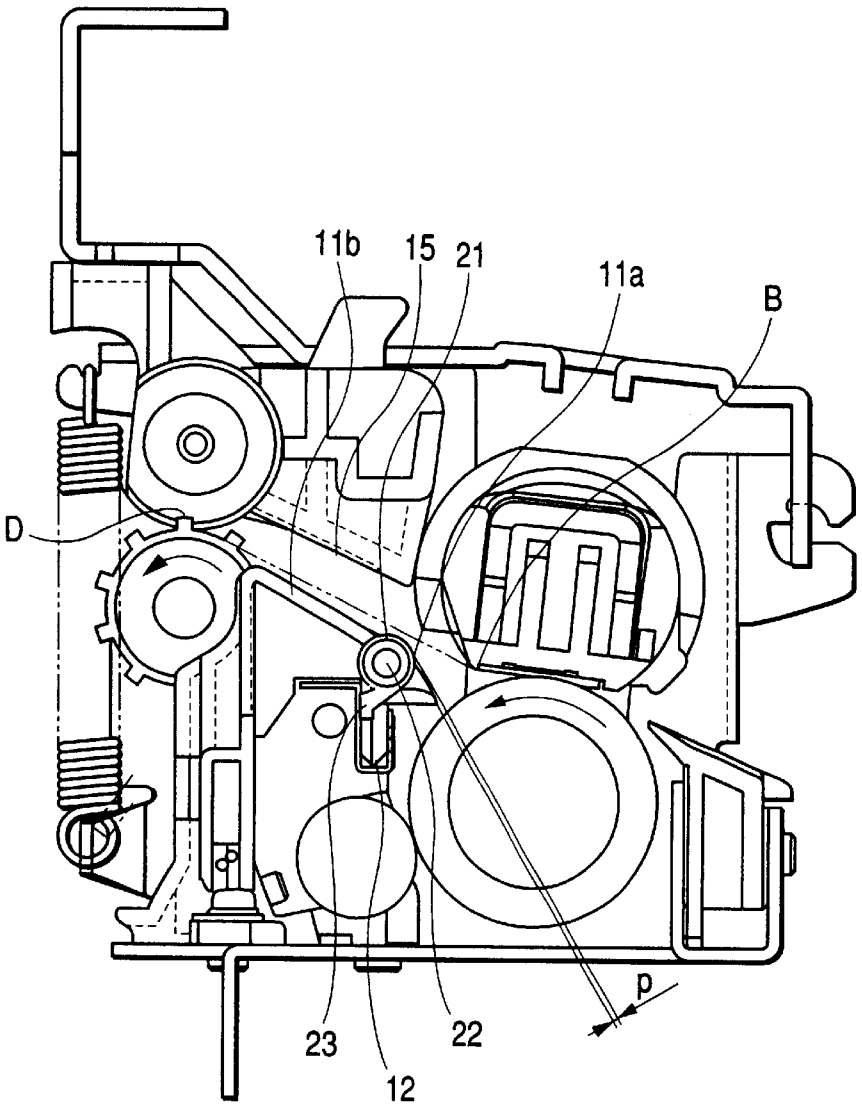
FIG. 5 is an illustration of a fixing apparatus in accordance with another embodiment of the present invention.
Figure 6:
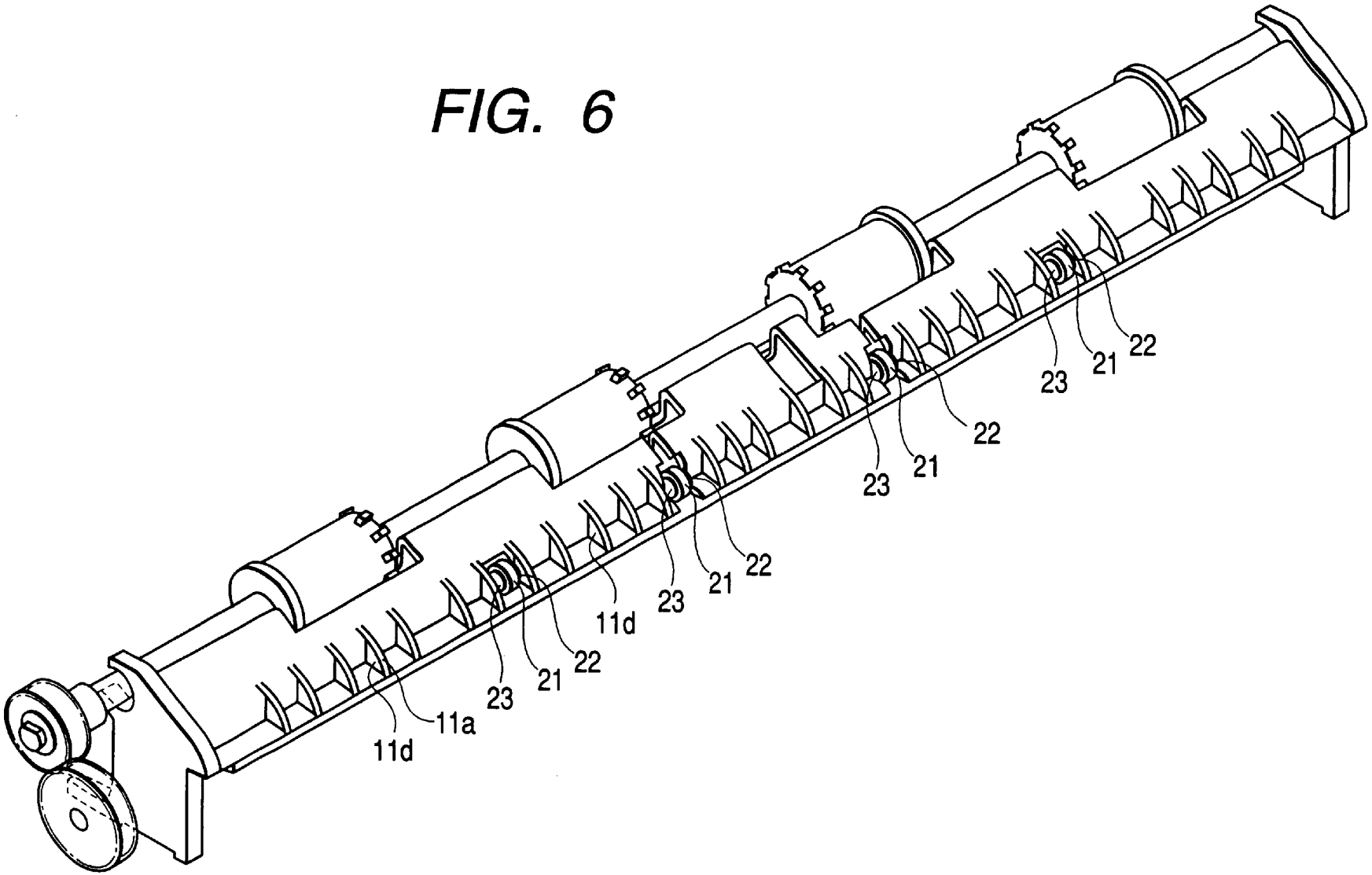
FIG. 6 is a perspective view of a guide member.

FIGS. 5 and 6 show a second embodiment of the present invention.

The second embodiment of the present invention will now be described with reference to FIGS. 5 and 6 and the same reference numerals are used to indicate the like components or members as those in the first embodiment. The explanation therefor will be omitted.

Also in this embodiment, in the same manner as in the first embodiment, the structural conditions of the fixing device 116 are the same as condition (1) to (5). Namely, in this case, it is possible to ensure the correction effect to the downward curl of the recording material S.

From the resent energy saving point of view, there is a tendency to suppress the fixing temperature, and a margin of the fixing property would be likely to be degraded. In the case where the structure according to the first embodiment is applied to the fixing device in which the margin of the fixing property is thus degraded, it is desired to take into consideration the case of the both-sided print mode.

Namely, since the first surface image of the tip end portion of the recording material S is strongly rubbed against the inlet slant surface 11*a* of the lower guide 11 as shown in FIGS. 3A, 3B and 3C, the first surface fixed image of the recording material S would be peeled off corresponding to the plurality of ribs when the sheet discharge of the second surface is conducted. Also, if the worse fixing conditions are met in, for example, kinds of sheet, circumstances, there is a fear that the peeled toner would adhere onto the lower guide 11 with an offset. This offset toner would gradually grow and finally, there is a fear that the toner would clog the transfer passage, which would lead to the jam.

In accordance with the embodiment, in order to cope with these disadvantages, as shown in FIGS. 5 and 6, roll members 21 which are projection portions projecting to the recording material guide side from the ribs are provided rotatably about roll shafts 22. As shown in FIG. 5, the roll members 21 are arranged to project by p from the inlet slant surface 11*a* of the lower guide 11.

The roll members 21 and the roll shafts 22 are supported to holders 23. The holders 23 are inserted into the U-bend of the reinforcement plate 12. It is preferable that the surfaces of the roll members 21 are smooth as much as possible and also have the low friction for smooth rotation. Teflon (registered trademark) resin such as PFA or PTFE or the like which is superior in surface property, mold releasing property and onto which the toner is hardly adhered, or a ball bearing available on the market may be used. In accordance with the experiments, with p=0.6 to 0.8 mm, the good result was obtained.

With such an arrangement, the tip end portion of the recording material S is scooped by the roll members 21, and there is no fear that the end portion would be brought into strong contact with the slant surfaces 11*a* of the plurality of ribs 11*d* formed on the inlet side of the lower guide 11. It is therefore possible to avoid the image peel at the tip end of the first surface.

Also, since the temperature elevation in the vicinity of the central portion of the sheet discharge guide 11 is remarkable due to the continuous operation of the fixing device, the image peel or the toner offset would be likely to occur. Accordingly, in this embodiment, as shown in FIG. 6, the roll members 21 are provided at four positions in the vicinity of the center of the lower guide 11.

Another feature of the present embodiment is, as shown in FIG. 5, that the line BD connecting the fixing heater outlet B and the sheet discharge nip D is always located above the roll members 21 and the inlet slant surface 11*a* and the outlet slant surface 11*b* of the sheet discharge lower guide 11.

Namely, the tip end portion of the recording material S that is directed upward by the inlet slant surface 11*a* of the lower guide 11 and the roll members 21 is advanced along the sheet discharge upper guide 15, and after the arrival at the sheet discharge nip D, as described above, the end portion is advanced while being tensioned between the fixing point and the sheet discharge. Accordingly, the first surface print would not come into contact with the lower guide.

Accordingly, there is no fear that the abrasion of the image would occur over the entire region of the recording material S, and it is possible to provide the fixing device that may correct the lower curl.

Figure 7:
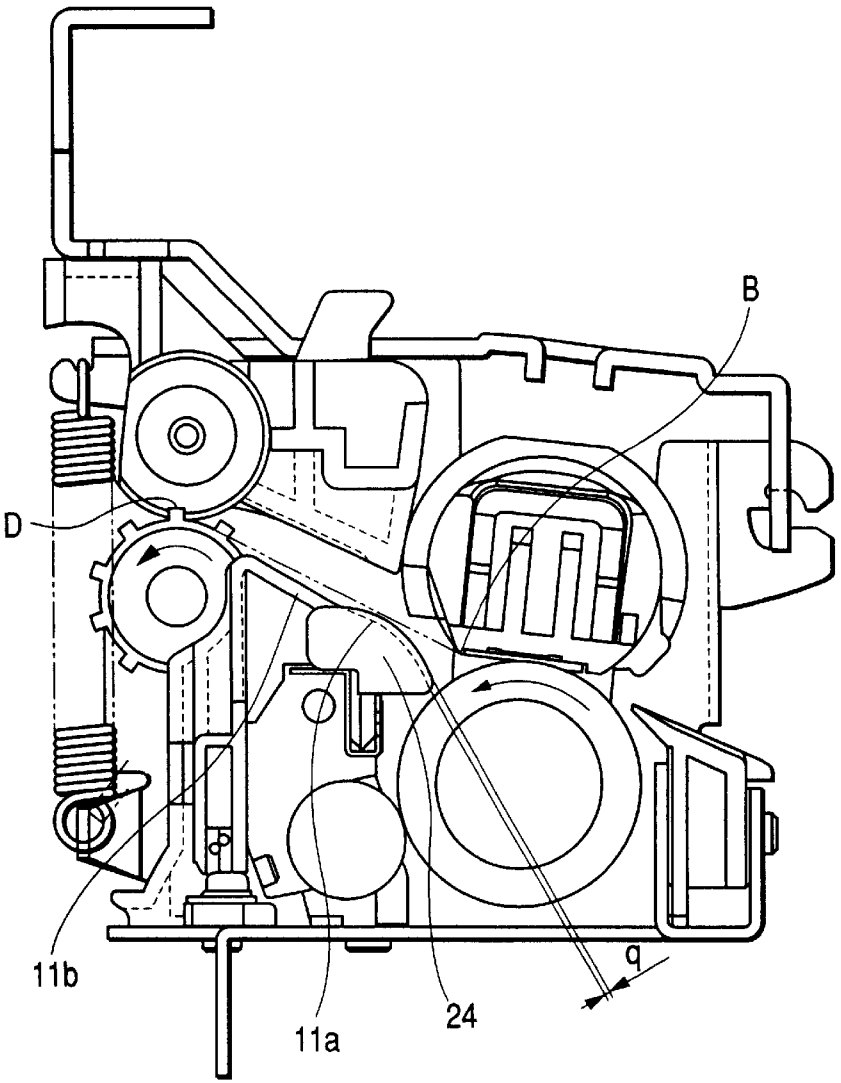
FIG. 7 is an illustration of a fixing apparatus in accordance with still another embodiment of the present invention.
Figure 8:
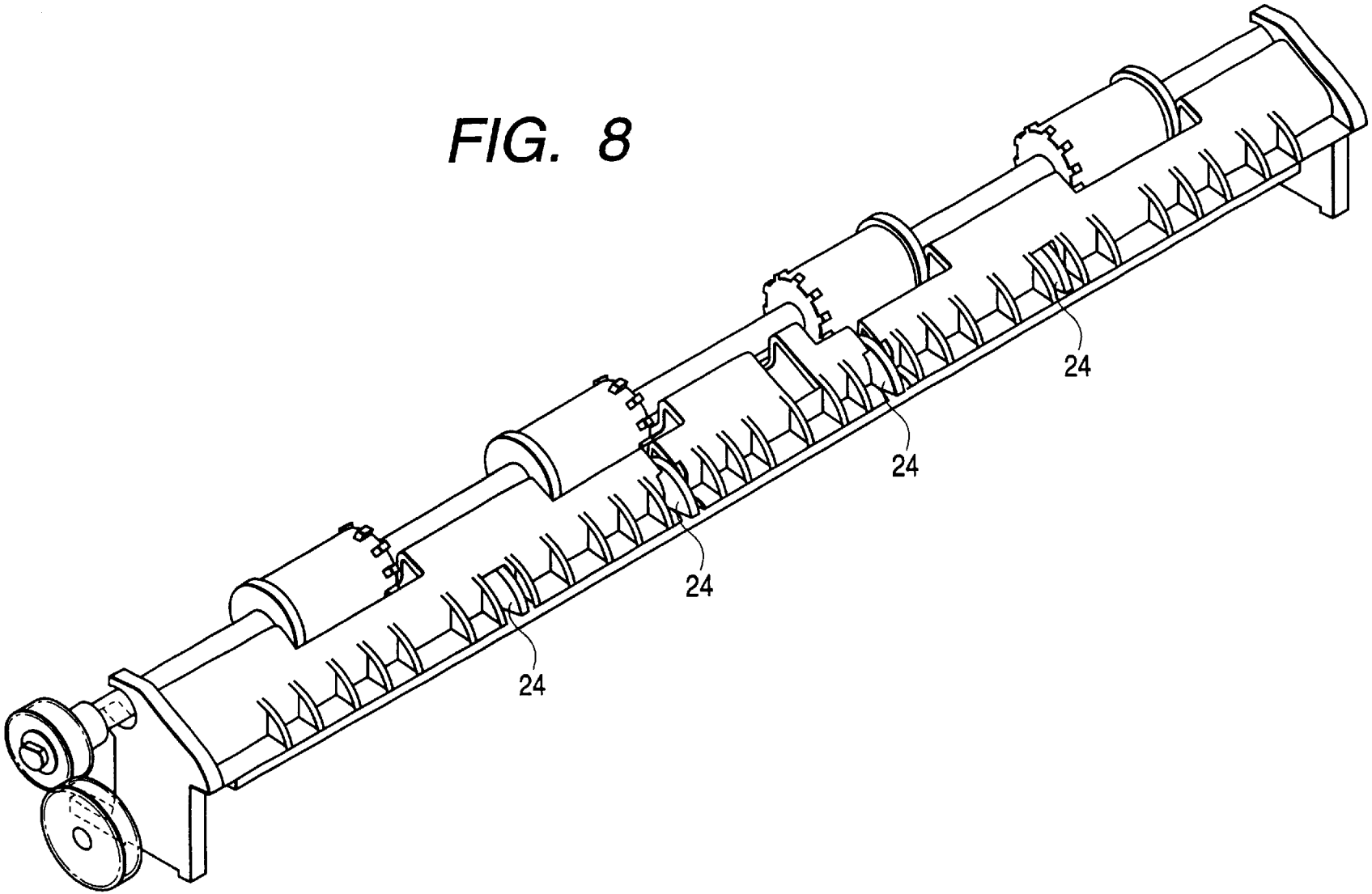
FIG. 8 is a perspective view of a guide member.

FIGS. 7 and 8 show a third embodiment of the present invention.

The third embodiment of the present invention will now be described with reference to FIGS. 7 and 8. The same reference numerals are used to indicate the like members or components as those in the first and second embodiments. The explanation thereof will be omitted.

Also in this embodiment, in the same manner as in the first and second embodiments, the structural conditions of the fixing device 116 are the same as condition (1) to (5). Namely, in this case, it is possible to ensure the correction effect to the downward curl of the recording material S.

In this embodiment, as shown in FIGS. 7 and 8, fixed ribs 24 that are the projection portions are arranged to be higher in level by q than the inlet slant surface 11*a* of the lower guide 11. It is preferable to use as the material of the fixed ribs 24 Teflon (registered trademark) resin such as PFA, PTFE or the like which has a low friction, which is superior in surface property, high in mold releasing property, and onto which the toner is hardly adhered. According to the experiments, the good result was obtained with the condition q=0.5 to 0.9 mm. Also, the fixed ribs 24 are arranged at four to six positions in the vicinity of the center of the lower guide 11 to thereby exhibit the effect.

Still another feature of the present embodiment is that the line BD connecting the fixing heater outlet B and the sheet discharge nip D is always located above the fixed ribs 24 and the inlet slant surface 11*a* and the outlet slant surface 11*b* of the sheet discharge lower guide 11.

When this condition is met, there is no fear that the recording material S is not rubbed against the lower guide 11 for the same reason as described above, and therefore, there is no fear that the first surface image would be peeled.

The effect of this embodiment is the same as that of the second embodiment. In addition, it is possible to reduce the number of the mechanical parts, which leads to reduction of cost.

Note that, the present invention is not limited to the film fixing device according to the first, second and third embodiments but may be applied to the downward curl correction in any type fixing device.

Thus, according to the present invention, it is possible to perform the correction of the downward curl tendency of the end portion of the recording material after the fixing nip by the slant surface on the side of the sheet discharge lower guide inlet.

Also, according to the present invention, since the slant surface on the side of the sheet discharge guide outlet is gentle, it is possible to stabilize the conveying of the recording material.

Also, according to the present invention, the downward curl tendency of the tip end portion of the recording material after the fixing nip is corrected by the slant surface on the side of the sheet discharge guide inlet, and furthermore, the downward curl may be corrected over the entire recording material by imparting the rigidity by the mechanical hysteresis utilizing the convey angle difference.

Also, according to the present invention, the downward curl tendency of the tip end portion of the recording material after the fixing nip is corrected by the slant surface on the side of the sheet discharge guide inlet, and furthermore, the downward curl may be corrected over the entire recording material by imparting the rigidity by the mechanical hysteresis utilizing the difference in convey angle and the velocity difference between the sheet discharge and the fixing between the sheet discharge and the fixing nip.

Also, according to the present invention, since the plurality of ribs are used to form the inlet slant surface of the above-described sheet discharge downward guide portion, it is possible to ensure the correction of the downward curl of the recording material while keeping a convey property of the thin sheet under the high temperature and high humidity circumstances.

Also, according to the present invention, since the fixed ribs or the rotatable roll members as the projection portions are provided so as to project somewhat from the inlet slant surface of the lower guide, and furthermore the line connecting the fixing and the sheet discharge nip is always located above the projection portions such as the above-described roll members or the fixed ribs and the lower guide portion, it is possible to provide the lower curl correction fixing device that may avoid the image peel in the both sided print mode.

Also, according to the present invention, it is possible to provide the excellent recording material with small curl. Also, it is possible to provide a highly reliable image forming apparatus which may be high in discharging and stacking property, and may reduce a trouble in the both sided print mode or ADF original mode.

As described above, the descriptions have been made of the embodiments of the present invention. However, it is understood that the present invention is not limited thereto or thereby and various modifications and changes are possible within the scope of the spirit of the invention.

What is claimed is:

1. A fixing apparatus comprising:

fixing means for forming a fixing nip, wherein a recording material bearing an unfixed image is pinched and conveyed in said fixing nip, the unfixed image is fixed on the recording material, and the recording material is discharged from said fixing nip being curled downwardly; and a guide member for guiding the recording material discharged from said fixing nip, said guide member being slanted upwardly from an upstream side to a downstream side in a recording material conveying direction, said guide member having a first guide portion and a second guide portion provided downstream in the recording material conveying direction of said first guide portion, and a slant of said first guide portion being greater than a slant of said second guide portion, wherein the slant angle of said first guide portion in the recording material conveying direction in said fixing nip is not less than 40 degrees but not greater than 65 degrees.

2. A fixing apparatus according to claim 1, further comprising discharge means for forming a discharge nip, the recording medium guided by said guide member being pinched and conveyed in said discharge nip.

3. A fixing apparatus according to claim 2, wherein the slant of a line connecting an end portion of said fixing means on an extension line of said fixing nip and said discharge nip is greater than the slant of said fixing nip.

4. A fixing apparatus according to claim 2, wherein a line connecting of an end portion of said fixing means on an extension line of said fixing nip and said discharge nip is above said guide member.

5. A fixing apparatus according to claim 2, wherein a conveying velocity of the recording material by said discharge means is greater than a conveying velocity of the recording material by said fixing means.

6. A fixing apparatus according to claim 2, wherein said discharge means is a pair of rollers.

7. A fixing apparatus according to claim 1, wherein said first guide portion has ribs.

8. A fixing apparatus according to claim 7, wherein said first guide portion has a projection portion projected greater than said ribs.

9. A fixing apparatus according to claim 8, wherein said projection portion is a low frictional portion.

10. A fixing apparatus according to claim 8, wherein said projection portion is a roller.

11. A fixing apparatus according to claim 1, wherein said fixing means includes a heater, a film that slides with said heater, and a roller for forming the fixing nip with said heater via said film, and the unfixed image is fixed on the recording material by heat from said heater via said film at said fixing nip.

12. A fixing apparatus comprising:

fixing means for forming a fixing nip; and a recording material bearing an unfixed image being pinched and conveyed in said fixing nip and the unfixed image being fixed on the recording material, and the recording material discharged from said fixing nip being curled downwardly, a guide member for guiding the recording material discharged from said fixing nip;

said guide member being slanted upwardly from an upstream side to a downstream side in a recording material conveying direction, the slant angle of said guide member in a recording material conveying direction in said fixing nip being not less than 40 degrees but not greater than 65 degrees.

13. A fixing apparatus according to claim 12, further comprising discharge means for forming a discharge nip, the recording medium guided by said guide member being pinched and conveyed in said discharge nip.

14. A fixing apparatus according to claim 13, wherein the slant of a line connecting an end portion of said fixing means on an extension line of said fixing nip and said discharge nip is greater than the slant of said fixing nip.

15. A fixing apparatus according to claim 13, wherein a line connecting to an end portion of said fixing means on an extension line of said fixing nip and said discharge nip is above said guide member.

16. A fixing apparatus according to claim 13, wherein a conveying velocity of the recording material by said discharge means is greater than a conveying velocity of the recording material by said fixing means.

17. A fixing apparatus according to claim 13, wherein said discharge means is a pair of rollers.

18. A fixing apparatus according to claim 12, wherein said first guide portion has ribs.

19. A fixing apparatus according to claim 18, wherein said first guide portion has a projection portion projected greater than said ribs.

20. A fixing apparatus according to claim 19, wherein said projection portion is a low frictional portion.

21. A fixing apparatus according to claim 19, wherein said projection portion is a roller.

22. A fixing apparatus according to claim 12, wherein said fixing means includes a heater, a film that slides with said heater, and a roller for forming the fixing nip with said heater via said film, and the unfixed image is fixed on the recording material by heat from said heater via said film at said fixing nip.

23. A fixing apparatus comprising:

fixing means for forming a nip, wherein a recording material bearing an unfixed image is pinched and conveyed in said fixing nip, the unfixed image is fixed on the recording material, and the recording material is discharged from said fixing nip being curled downwardly; and a guide member for guiding the recording material discharged from said fixing nip, said guide member being slanted upwardly from an upstream side to a downstream side in a recording material conveying direction, said guide member having a first guide portion and a second guide portion provided downstream in the recording material conveying direction of said first guide portion, and a slant of said first guide portion being greater than a slant of said second guide portion, wherein said first guide portion has ribs and a projection portion projected greater than said ribs.

24. A fixing apparatus according to claim 23, further comprising discharge means for forming a discharge nip, the recording medium guided by said guide member being pinched and conveyed in said discharge nip.

25. A fixing apparatus according to claim 24, wherein the slant of a line connecting an end portion of said fixing means on an extension line of said fixing nip and said discharge nip is greater than the slant of said fixing nip.

26. A fixing apparatus according to claim 24, wherein a line connecting to an end portion of said fixing means on an extension line of said fixing nip and said discharge nip is above said guide member.

27. A fixing apparatus according to claim 24, wherein a conveying velocity of the recording material by said discharge means is greater than a conveying velocity of the recording material by said fixing means.

28. A fixing apparatus according to claim 24, wherein said discharge means is a pair of rollers.

29. A fixing apparatus according to claim 23, wherein said projection portion is a low frictional portion.

30. A fixing apparatus according to claim 23, wherein said projection portion is a roller.

31. A fixing apparatus according to claim 23, wherein said fixing means includes a heater, a film that slides with said heater, and a roller for forming the fixing nip with said heater via said film, and the unfixed image is fixed on the recording material by heat from said heater via said film at said fixing nip.

* * * * *

UNITED STATES PATENT AND TRADEMARK OFFICE

CERTIFICATE OF CORRECTION

PATENT NO. : 6,298,214 B1
DATED : October 2, 2001
INVENTOR(S) : Hiroto Koga

It is certified that error appears in the above-identified patent and that said Letters Patent is hereby corrected as shown below:

Column 1,
Line 15, "to" should be deleted.

Column 7,
Line 30, "adhere" should read -- adhered --.

Column 8,
Line 42, "resent" should read -- recent --.

Column 11,
Line 34, "of" (1st occurrence) should be deleted.

Column 12,
Line 3, "direction," should read -- direction, and --.
Line 16, "to" should be deleted.

Signed and Sealed this

Fifth Day of March, 2002

*Attest:*

*Attesting Officer*

JAMES E. ROGAN
*Director of the United States Patent and Trademark Office*